US011389018B2

(12) United States Patent
Bradstreet

(10) Patent No.: US 11,389,018 B2
(45) Date of Patent: Jul. 19, 2022

(54) HEAD AND NECK SUPPORT ASSEMBLY

(71) Applicant: Steven Bradstreet, Miamisburg, OH (US)

(72) Inventor: Steven Bradstreet, Miamisburg, OH (US)

( * ) Notice: Subject to any disclaimer, the term of this patent is extended or adjusted under 35 U.S.C. 154(b) by 100 days.

(21) Appl. No.: 16/880,671

(22) Filed: May 21, 2020

(65) Prior Publication Data

US 2021/0361095 A1 Nov. 25, 2021

(51) Int. Cl.
*A47G 9/10* (2006.01)

(52) U.S. Cl.
CPC ..... *A47G 9/1054* (2013.01); *A47G 9/1081* (2013.01); *A47G 9/1045* (2013.01)

(58) Field of Classification Search
CPC .. A61G 13/009; A61G 13/105; A61G 13/121; A47G 9/1054; A47G 9/1081; A47G 9/1045; A47C 20/026
See application file for complete search history.

(56) References Cited

U.S. PATENT DOCUMENTS 1,542,674 A * 6/1925 Darling ..... A61G 7/072 5/632
2,775,999 A * 1/1957 Goodeve ..... A47C 7/383 297/353
2,952,856 A * 9/1960 Ruff ..... A47G 9/10 5/640
3,140,497 A * 7/1964 Carswell ..... A47G 9/10 5/638
3,343,531 A * 9/1967 Thompson ..... A61G 13/009 606/237
3,926,181 A * 12/1975 Eischen, Sr. ..... A61G 13/12 602/18
5,054,142 A * 10/1991 Owens ..... A47C 17/04 5/633
5,632,050 A * 5/1997 Zajas ..... A47C 20/026 5/632
5,661,860 A 9/1997 Heitz
5,893,183 A 4/1999 Bechtold, Jr.
D414,974 S 10/1999 Marrone, II
6,154,903 A * 12/2000 Wai-Chung ..... A47C 20/026 5/632
6,185,768 B1 * 2/2001 Schlechter ..... A47C 20/026 5/632
6,412,127 B1 * 7/2002 Cuddy ..... A47C 20/026 5/632
6,718,581 B2 4/2004 Riach
6,922,860 B2 * 8/2005 Cuddy ..... A47C 20/026 5/632
7,020,918 B1 4/2006 Tinsley
(Continued)

*Primary Examiner* — Eric J Kurilla

(57) ABSTRACT

A head and neck support assembly for supporting a user's head and shoulder when the user is lying face down includes a head cushion that is positionable on a support surface to support a user's head above the support surface. The head cushion has a plurality of air passages is integrated therein to facilitating the user to breathe when the user is lying face down. A shoulder cushion is movably coupled to the head cushion and the shoulder cushion is oriented to extend along a line is oriented perpendicular to a center line of the head cushion. In this way the shoulder cushion supports the user's clavicles above the support surface and the shoulder cushion is foldable into a storage position.

9 Claims, 8 Drawing Sheets

(56) References Cited

U.S. PATENT DOCUMENTS 7,475,439 B1 * 1/2009 Cox ..... A61G 13/009 5/632
7,634,829 B1 * 12/2009 La Bar ..... A47C 20/026 5/632
8,006,335 B1 8/2011 Andermann
8,549,683 B2 * 10/2013 Ratner ..... A61G 13/121 5/638
8,850,641 B2 10/2014 Marbury, III
9,131,792 B1 * 9/2015 Wagner ..... A47C 20/026
9,174,081 B2 * 11/2015 Cecil ..... A63B 21/15
9,308,147 B2 * 4/2016 Davis ..... A61G 13/1215
10,244,878 B2 4/2019 Doughty
2006/0021146 A1 * 2/2006 Tokarz ..... A47C 20/021 5/632
2006/0137100 A1 6/2006 Barczyk
2007/0251010 A1 * 11/2007 Lara ..... A61G 13/009 5/620
2011/0277243 A1 * 11/2011 Crompton ..... A47C 20/026 5/632
2011/0296620 A1 * 12/2011 Gard ..... A61G 13/121 5/661
2012/0304387 A1 * 12/2012 Crompton ..... A47C 20/026 5/632
2013/0245395 A1 * 9/2013 Bidarian Moniri ..... A61B 7/00 600/301
2014/0053337 A1 * 2/2014 Mac Marbury, III ..... A47G 9/1054 5/638
2015/0223622 A1 * 8/2015 Mobley ..... A47G 9/1054 5/638
2016/0081485 A1 * 3/2016 Tovar ..... A47G 9/1054 5/631
2016/0278535 A1 9/2016 Koutsouradis
2017/0202378 A1 * 7/2017 Scrimshaw ..... A47G 9/1081
2018/0220818 A1 * 8/2018 Doughty ..... A61F 5/56
2020/0352366 A1 * 11/2020 Brooks ..... A61G 13/009

* cited by examiner

HEAD AND NECK SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bodily support device and more particularly pertains to a new bodily support device for supporting a user's head and shoulders when the user is lying face down.

(2) Description of Related Art Including Information Disclosed Under 37 CFR 1.97 and 1.98

The prior art relates to bodily support devices including a body pillow that includes a rigid panel and a donut cushion for a user's face. The prior art also discloses a body pillow system that includes a body wedge and a face pillow with a breathing hole. The prior art discloses an adjustable support device that includes a chest pillow and a head pillow being attached to articulated arms. The prior art discloses a variety of body support devices that include a plurality of wedges and a face pillow for supporting a user in a prone position. The prior art further discloses a body pillow system that includes a block cushion and a donut cushion.

BRIEF SUMMARY OF THE INVENTION

An embodiment of the disclosure meets the needs presented above by generally comprising a head cushion that is positionable on a support surface to support a user's head above the support surface. The head cushion has a plurality of air passages is integrated therein to facilitating the user to breathe when the user is lying face down. A shoulder cushion is movably coupled to the head cushion and the shoulder cushion is oriented to extend along a line is oriented perpendicular to a center line of the head cushion. In this way the shoulder cushion supports the user's clavicles above the support surface and the shoulder cushion is foldable into a storage position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
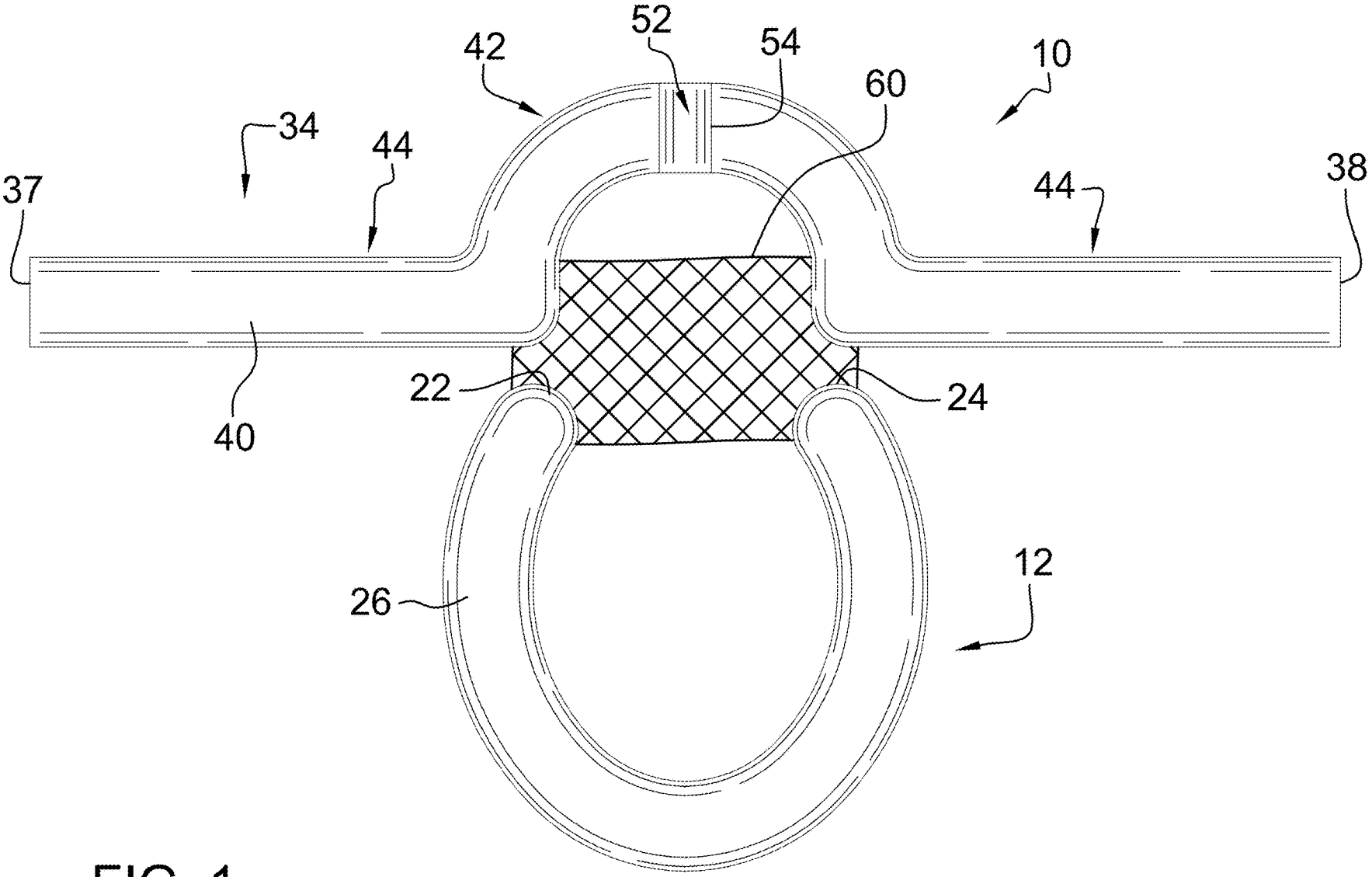
FIG. 1 is a top view of a head and neck support assembly according to an embodiment of the disclosure.
Figure 2:
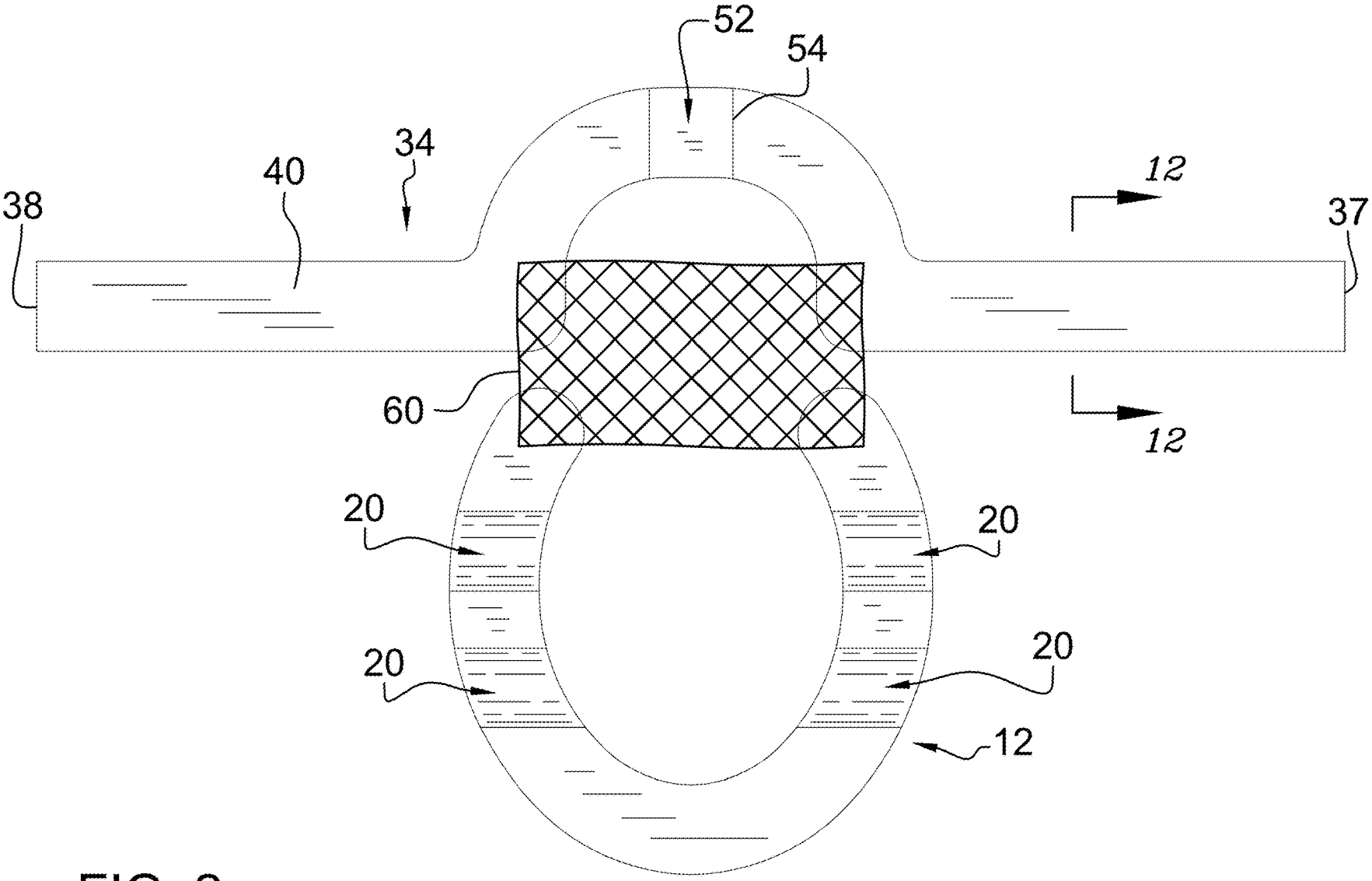
FIG. 2 is a bottom view of an embodiment of the disclosure.
Figure 4:
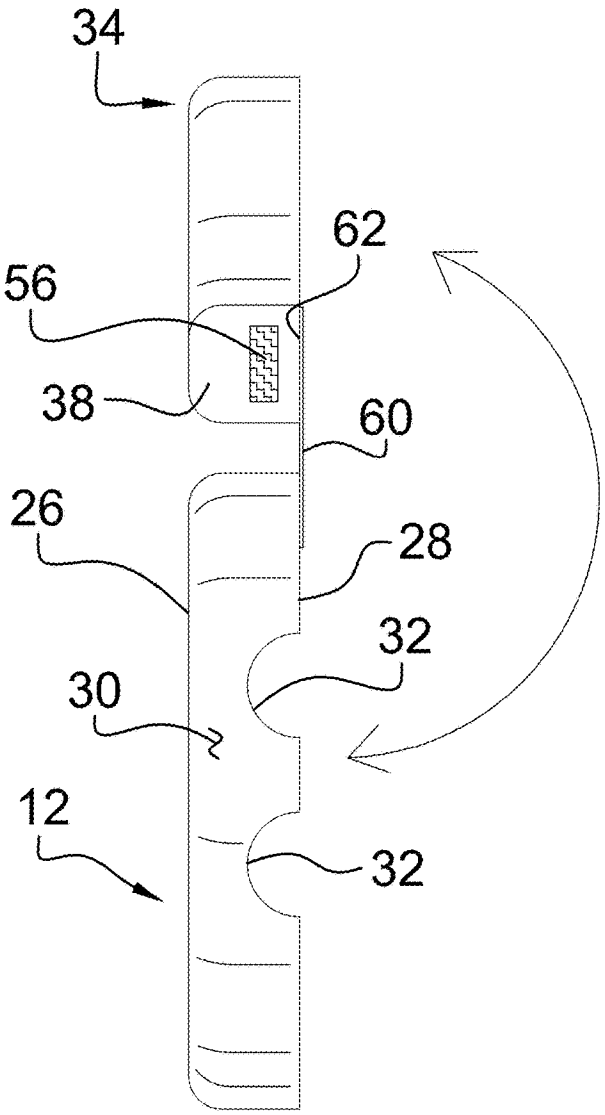
FIG. 4 is a left side view of an embodiment of the disclosure.
Figure 3:
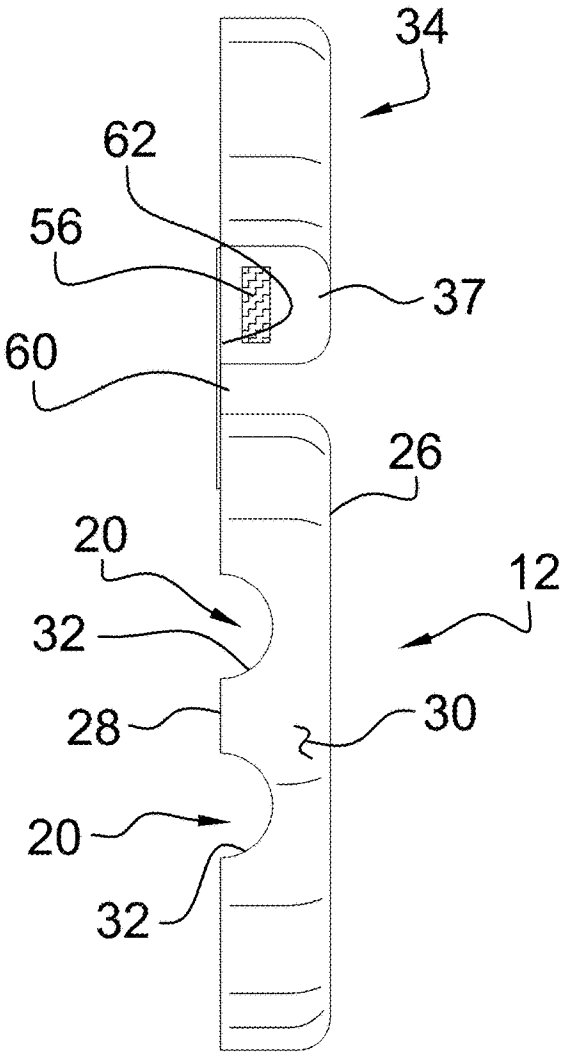
FIG. 3 is a right side view of an embodiment of the disclosure.
Figure 5:
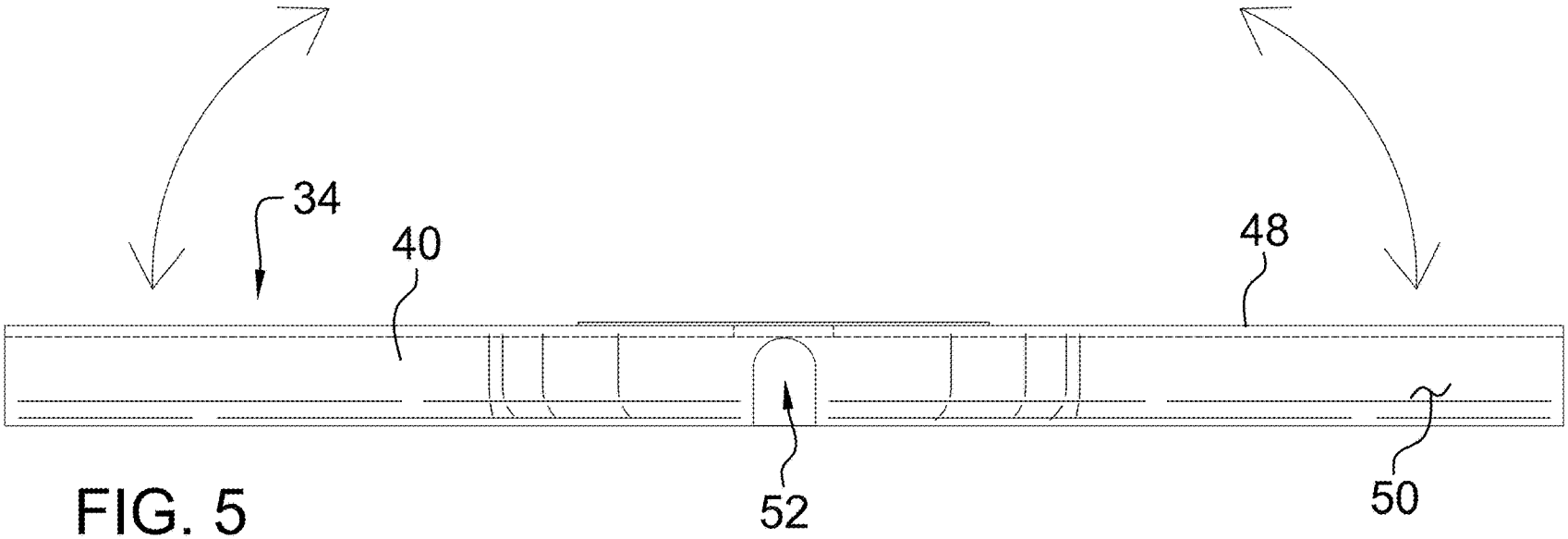
FIG. 5 is a front view of an embodiment of the disclosure.
Figure 6:
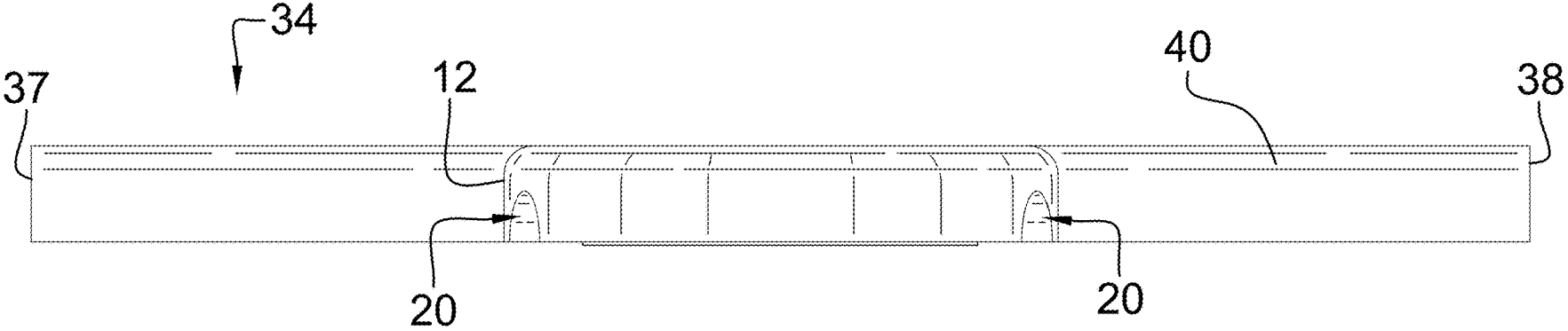
FIG. 6 is a back view of an embodiment of the disclosure.
Figure 8:
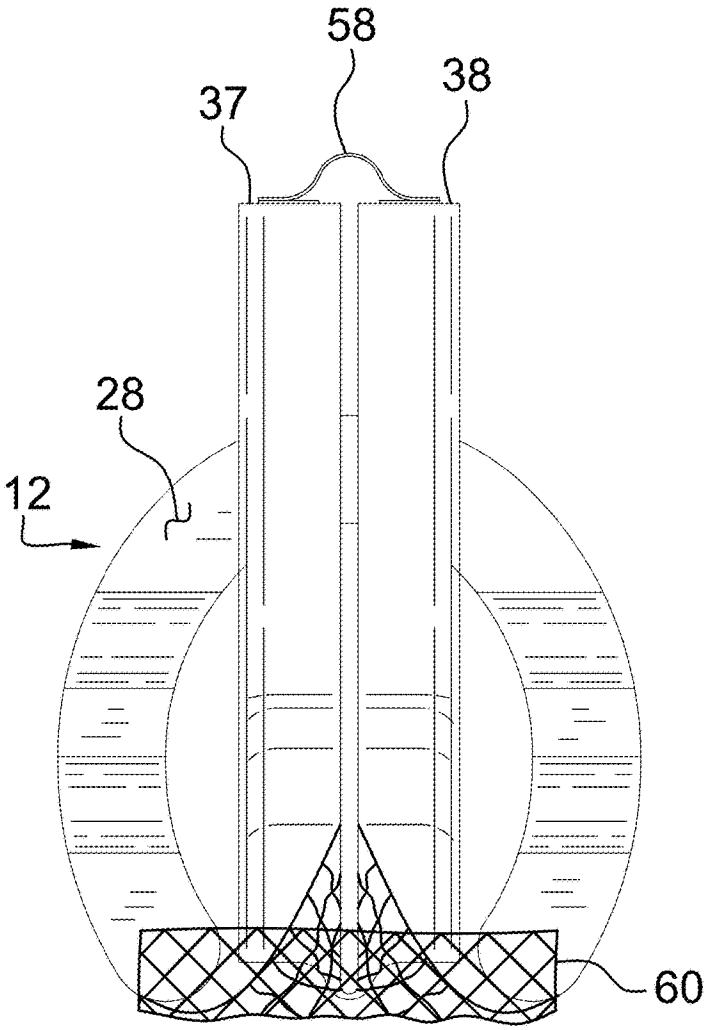
FIG. 8 is a bottom view of an embodiment of the disclosure showing a shoulder cushion being folded for storage.
Figure 7:
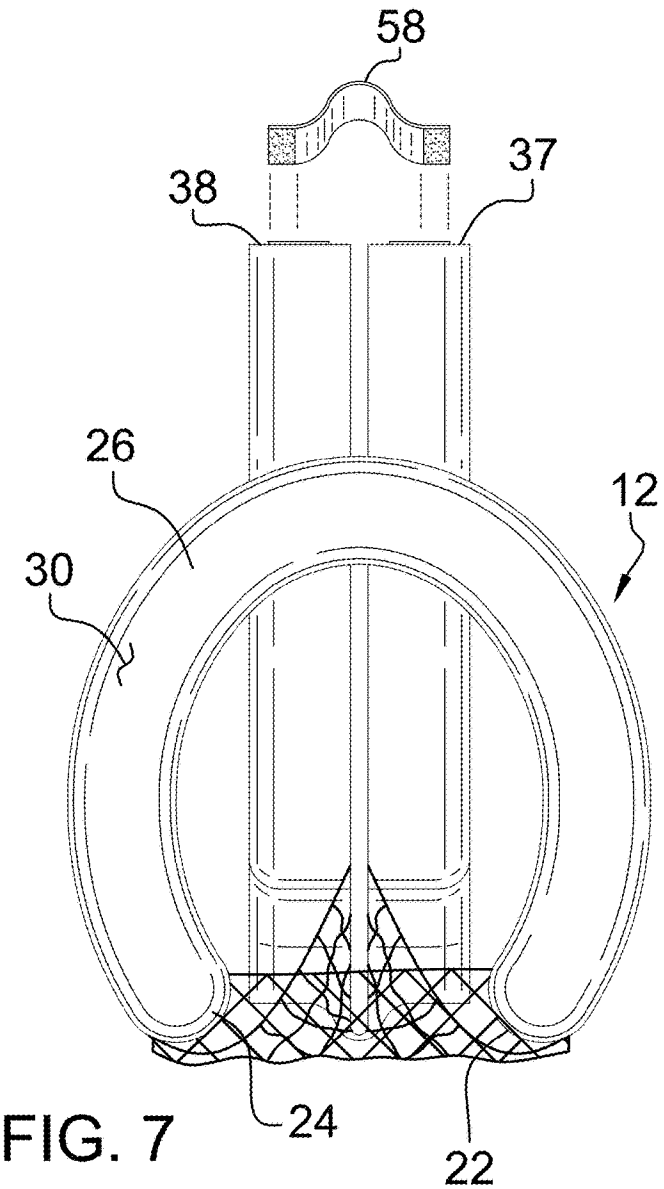
FIG. 7 is a top view of an embodiment of the disclosure showing a shoulder cushion being folded for storage.
Figure 10:
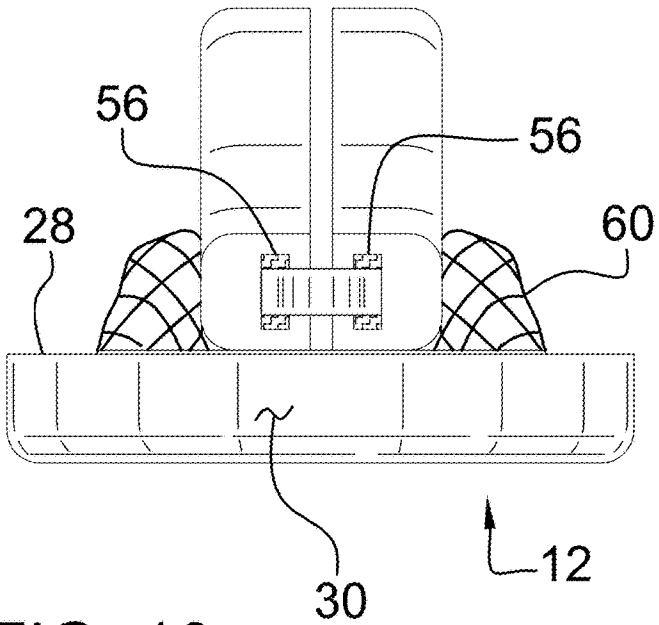
FIG. 10 is a front view of an embodiment of the disclosure showing a shoulder cushion being folded for storage.
Figure 9:
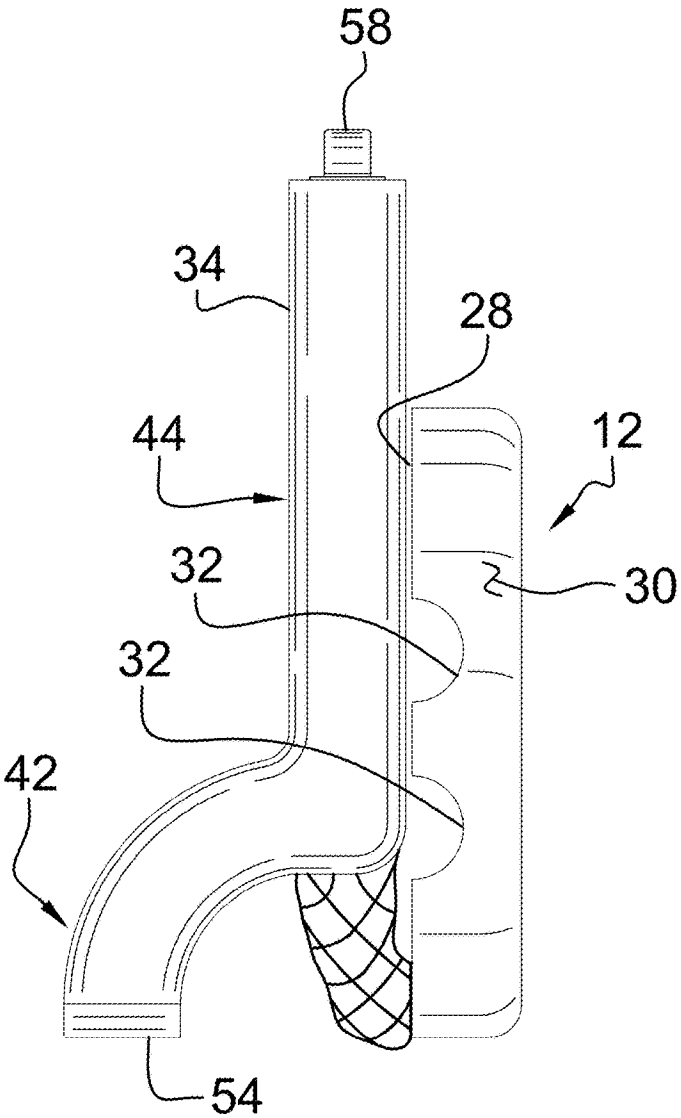
FIG. 9 is a left side view of an embodiment of the disclosure showing a shoulder cushion being folded for storage.
Figure 11:
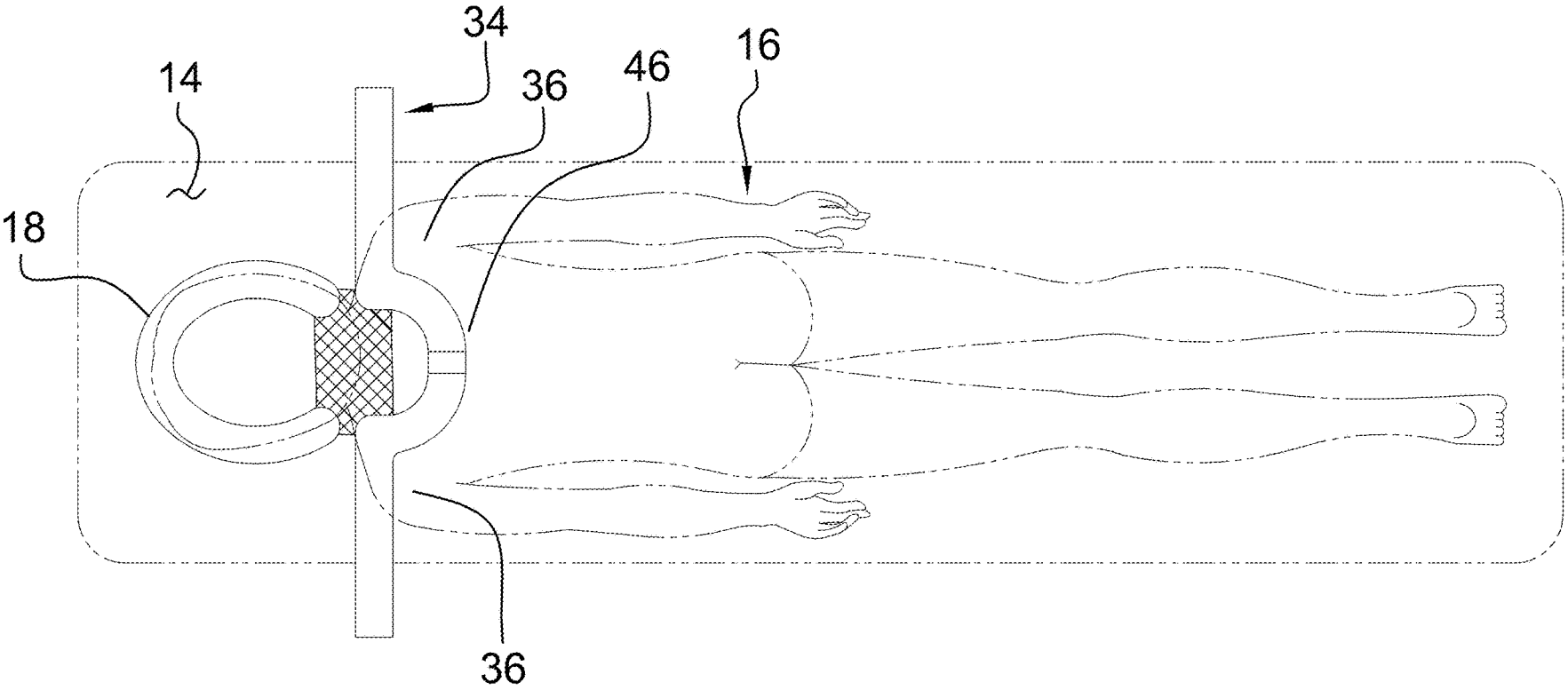
FIG. 11 is a perspective in-use view of an embodiment of the disclosure.
Figure 12:
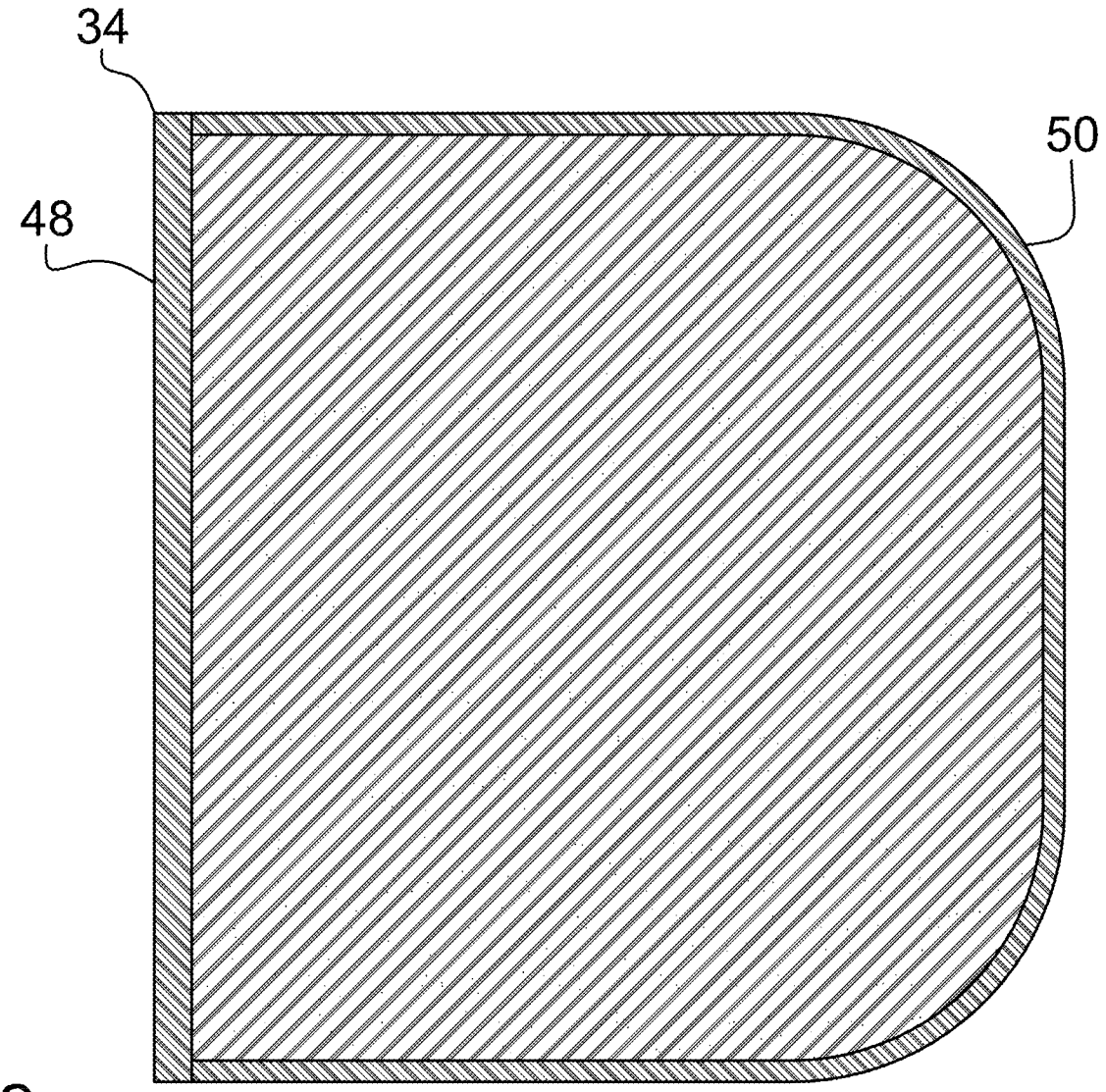
FIG. 12 is a cross sectional view taken along line 12-12 of FIG. 2 of an embodiment of the disclosure.

With reference now to the drawings, and in particular to FIGS. 1 through 12 thereof, a new bodily support device embodying the principles and concepts of an embodiment of the disclosure and generally designated by the reference numeral 10 will be described.

As best illustrated in FIGS. 1 through 12, the head and neck support assembly 10 generally comprises a head cushion 12 is positionable on a support surface 14 upon which a user 16 will lie to support the user's head 18 above the support surface 14. The support surface 14 may be a massage table, a bed, a floor or any other horizontal surface. The head cushion 12 has a plurality of air passages 20 integrated therein to pass air therethrough when the head cushion 12 is lying on the support surface 14. In this way the user 16 can breathe when the user 16 is lying face down without requiring the user 16 to turn their head 18.

The head cushion 12 has a first end 22, a second end 24 and an outer wall 26 extending therebetween. The head cushion 12 is curved between the first end 22 and the second end 24 having the first end 22 and the second end 24 being spaced apart from each other such that the head cushion 12 has a horseshoe shape. The outer wall 26 has a lower surface 28 and an upper surface 30, the lower surface 28 is flattened and the upper surface 30 is concavely arcuate with respect to the lower surface 28. Additionally, the lower surface 28 has a plurality of channels 32 each extending toward the upper surface 30 such that each of the channels 32 forms the air passages 20 when the lower surface 28 rests on the support surface 14 upon which the user 16 is lying. Each of the channels 32 extends laterally across the lower surface 28. The upper surface 30 is comprised of a resiliently pliable material, the lower surface 28 is comprised of a rigid material and the head cushion 12 is filled with a resiliently compressible material to enhance comfort for the user 16.

A shoulder cushion 34 is provided and the shoulder cushion 34 is movably coupled to the head cushion 12. The shoulder cushion 34 is oriented to extend along a line that is oriented perpendicular to a center line of the head cushion 12. In this way the shoulder cushion 34 can support the user's clavicles 36 above the support surface 14 upon which the user 16 is lying. Additionally, the shoulder cushion 34 is foldable into a storage position.

The shoulder cushion 34 has a primary end 37, a secondary end 38 and an outside wall 40 extending therebetween, and the outside wall 40 has a curved portion 42 that is centrally positioned between the primary end 37 and the secondary end 38. The outside wall 40 has a pair of straightened portions 44 each extending between the curved portion 42 and a respective one of the primary end 37 and the secondary end 38. Additionally, the curved portion 42 is concavely arcuate with respect to the straightened portions 44 to support the user's sternum 46 when the user 16 is lying on the support surface 14. The outside wall 40 has a bottom surface 48 and a top surface 50, the bottom surface 48 is flattened and the top surface 50 is concavely arcuate with respect to the bottom surface 48.

The bottom surface 48 has a channel 52 extending toward the top surface 50 to define a foldable section 54 of the shoulder cushion 34. The foldable section 54 is positioned on the curved portion 42 and the foldable section 54 is centrally positioned between each of the straightened portions 44. The foldable section 54 extends along a line that is oriented perpendicular to a centerline of the straightened portions 44. The shoulder cushion 34 is foldable along the foldable section 54 having each of the straightened portions 44 abutting each other for storing the shoulder cushion 34. Additionally, the primary end 37 is positioned adjacent to the secondary end 38 when the shoulder cushion 34 is folded. The shoulder cushion 34 is filled with a resiliently compressible material to enhance comfort for the user 16.

A pair of first mating members 56 is each coupled to a respective one of the primary end 37 and the secondary end 38 of the shoulder cushion 34. Each of the first mating members 56 may be hook and loop fasteners or other similar type of releasable, multiple use fasteners. A second mating member 58 is provided and the second mating member 58 is matable to each of the first mating members 56 when the shoulder cushion 34 is folded for retaining the shoulder cushion 34 in a folded orientation. The second mating member 58 may be a hook and loop fastener or other similar type of releasable, multiple use fastener.

A panel 60 is coupled between the head cushion 12 and the shoulder cushion 34 such that the head cushion 12 is attached to the shoulder cushion 34. The panel 60 has a first surface 62 and the first surface 62 is coupled to the lower surface 28 of the outer wall 26 of the head cushion 12 at two points located adjacent to each of the first end 22 and the second end 24 of the head cushion 12. Moreover, the first surface 62 is coupled to the bottom surface 48 of the outside wall 40 of the shoulder cushion 34 at two points each being aligned with an intersection between each of the straightened portions 44 and the curved portion 42 of the shoulder cushion 34.

The panel 60 is comprised of a deformable material, such as mesh, fabric or other similar material. Each of the first end 22 and the second end 24 of the head cushion 12 is directed toward the intersection between the straightened portions 44 and the curved portion 42. Additionally, the curved portion 42 of the shoulder cushion 34 curves away from the head cushion 12. The head cushion 12 rests against the shoulder cushion 34 for storage when the panel 60 is folded.

In use, each of the head cushion 12 and the shoulder cushion 34 are laid on the support surface 14. The user 16 lies on the head cushion 12 and the shoulder cushion 34 when the user 16 lies on the support surface 14. Additionally, the head cushion 12 surrounds the user's face 64 and the user's clavicles 36 lay on the shoulder cushion 34 when the user 16 lies face down. In this way the head cushion 12 and the shoulder cushion 34 facilitate orthopedic support for the user's neck and upper back when the user 16 is lying face down. Additionally, the air passages 20 facilitate the user 16 to breathe without requiring the user 16 to turn their head 18. Thus, the head cushion 12 and the shoulder cushion 34 enhance comfort for the user 16 when the user 16 is getting a back massage. The shoulder cushion 34 is folded at the foldable section 54 and the second mating member 58 is mated to each of the first mating members 56 for retaining the shoulder cushion 34 in the folded orientation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A head and neck support assembly for supporting a user's head, neck and shoulders when the user is lying face down, said assembly comprising:

a head cushion being positionable on a support surface upon which a user will lie wherein said head cushion is configured to support the user's head above the support surface, said head cushion having a plurality of air passages being integrated therein wherein said air passages are configured to pass air therethrough to facilitating the user to breathe when the user is lying face down;

a shoulder cushion being movably coupled to said head cushion, said shoulder cushion being oriented to extend along a line being oriented perpendicular to a center line of said head cushion wherein said shoulder cushion is configured to support the user's clavicles above the support surface upon which the user is lying, said shoulder cushion being foldable into a storage position;

a panel being coupled between said head cushion and said shoulder cushion such that said head cushion is attached to said shoulder cushion; and wherein said shoulder cushion has a primary end, a secondary end and an outside wall extending therebetween, said outside wall having a curved portion being centrally positioned between said primary end and said secondary end, said outside wall having a pair of straightened portions each extending between said curved portion and a respective one of said primary end and said secondary end, said curved portion being concavely arcuate with respect to said straightened portions wherein said curved portion is configured to support the user's sternum when the user is lying on the support surface.

2. The assembly according to claim 1, wherein said head cushion has a first end, a second end and an outer wall extending therebetween, said head cushion being curved between said first end and said second end having said first end and said second end being spaced apart from each other such that said head cushion has a horseshoe shape.

3. The assembly according to claim 2, wherein said outer wall has a lower surface and an upper surface, said lower surface being flattened, said upper surface being concavely arcuate with respect to said lower surface, said lower surface having a plurality of channels each extending toward said upper surface such that each of said channels forms said air passages when said lower surface rests on the support surface upon which the user is lying, each of said channels extending laterally across said lower surface.

4. The assembly according to claim 2, wherein said upper surface is comprised of a resiliently pliable material, said lower surface being comprised of a rigid material.

5. The assembly according to claim 1, wherein said outside wall has a bottom surface and a top surface, said bottom surface being flattened, said top surface being concavely arcuate with respect to said bottom surface, said bottom surface having a channel extending toward said top surface to define a foldable section of said shoulder cushion, said foldable section being positioned on said curved portion, said foldable section being centrally positioned between each of said straightened portions, said foldable section extending along a line being oriented perpendicular to a centerline of said straightened portions.

6. The assembly according to claim 5, wherein said shoulder cushion is foldable along said foldable section having each of said straightened portions abutting each other for storing said shoulder cushion, said primary end being positioned adjacent to said secondary end when said shoulder cushion is folded.

7. The assembly according to claim 1, further comprising a pair of first mating members, each of said first mating members being coupled to a respective one of said primary end and said secondary end of said shoulder cushion; and a second mating member being matable to each of said first mating members when said shoulder cushion for retaining said shoulder cushion in a folded orientation.

8. A head and neck support assembly for supporting a user's head, neck and shoulders when the user is lying face down, said assembly comprising:

a head cushion being positionable on a support surface upon which a user will lie wherein said head cushion is configured to support the user's head above the support surface, said head cushion having a plurality of air passages being integrated therein wherein said air passages are configured to pass air therethrough to facilitating the user to breathe when the user is lying face down;

a shoulder cushion being movably coupled to said head cushion, said shoulder cushion being oriented to extend along a line being oriented perpendicular to a center line of said head cushion wherein said shoulder cushion is configured to support the user's clavicles above the support surface upon which the user is lying, said shoulder cushion being foldable into a storage position;

a panel being coupled between said head cushion and said shoulder cushion such that said head cushion is attached to said shoulder cushion;

wherein said head cushion has a first end, a second end and an outer wall extending therebetween, said head cushion being curved between said first end and said second end having said first end and said second end being spaced apart from each other such that said head cushion has a horseshoe shape, said outer wall having a lower surface and an upper surface;

wherein said shoulder cushion has a primary end, a secondary end and an outside wall extending therebetween, said outside wall having a curved portion being centrally positioned between said primary end and said secondary end, said outside wall having a pair of straightened portions each extending between said curved portion and a respective one of said primary end and said secondary end, said curved portion being concavely arcuate with respect to said straightened portions wherein said curved portion is configured to support the user's sternum when the user is lying on the support surface, said outside wall having a bottom surface and a top surface; and wherein said panel has a first surface, said first surface being coupled to said lower surface of said outer wall of said head cushion at two points located adjacent to each of said first end and said second end of said head cushion, said first surface being coupled to said bottom surface of said outside wall of said shoulder cushion at two points being aligned with an intersection between each of said straightened portions and said curved portion of said shoulder cushion, said panel being comprised of a deformable material, each of said first end and said second end of said head cushion being directed toward said intersection between said straightened portions and said curved portion, said head cushion resting against said shoulder cushion for storage when said panel is folded.

9. A head and neck support assembly for supporting a user's head, neck and shoulders when the user is lying face down, said assembly comprising:

a head cushion being positionable on a support surface upon which a user will lie wherein said head cushion is configured to support the user's head above the support surface, said head cushion having a plurality of air passages being integrated therein wherein said air passages are configured to pass air therethrough to facilitating the user to breathe when the user is lying face down, said head cushion having a first end, a second end and an outer wall extending therebetween, said head cushion being curved between said first end and said second end having said first end and said second end being spaced apart from each other such that said head cushion has a horseshoe shape, said outer wall having a lower surface and an upper surface, said lower surface being flattened, said upper surface being concavely arcuate with respect to said lower surface, said lower surface having a plurality of channels each extending toward said upper surface such that each of said channels forms said air passages when said lower surface rests on the support surface upon which the user is lying, each of said channels extending laterally across said lower surface, said upper surface being comprised of a resiliently pliable material, said lower surface being comprised of a rigid material, said head cushion being filled with a resiliently compressible material wherein said head cushion is configured to enhance comfort for the user;

a shoulder cushion being movably coupled to said head cushion, said shoulder cushion being oriented to extend along a line being oriented perpendicular to a center line of said head cushion wherein said shoulder cushion is configured to support the user's clavicles above the support surface upon which the user is lying, said shoulder cushion being foldable into a storage position, said shoulder cushion having a primary end, a secondary end and an outside wall extending therebetween, said outside wall having a curved portion being centrally positioned between said primary end and said secondary end, said outside wall having a pair of straightened portions each extending between said curved portion and a respective one of said primary end and said secondary end, said curved portion being concavely arcuate with respect to said straightened portions wherein said curved portion is configured to support the user's sternum when the user is lying on the support surface, said outside wall having a bottom surface and a top surface, said bottom surface being flattened, said top surface being concavely arcuate with respect to said bottom surface, said bottom surface having a channel extending toward said top surface to define a foldable section of said shoulder cushion, said foldable section being positioned on said curved portion, said foldable section being centrally positioned between each of said straightened portions, said foldable section extending along a line being oriented perpendicular to a centerline of said straightened portions, said shoulder cushion being foldable along said foldable section having each of said straightened portions abutting each other for storing said shoulder cushion, said primary end being positioned adjacent to said secondary end when said shoulder cushion is folded, said shoulder cushion being filled with a resiliently compressible material wherein said shoulder cushion is configured to enhance comfort for the user;

a pair of first mating members, each of said first mating members being coupled to a respective one of said primary end and said secondary end of said shoulder cushion;

a second mating member being matable to each of said first mating members when said shoulder cushion for retaining said shoulder cushion in a folded orientation; and a panel being coupled between said head cushion and said shoulder cushion such that said head cushion is attached to said shoulder cushion, said panel having a first surface, said first surface being coupled to said lower surface of said outer wall of said head cushion at two points located adjacent to each of said first end and said second end of said head cushion, said first surface being coupled to said bottom surface of said outside wall of said shoulder cushion at two points being aligned with an intersection between each of said straightened portions and said curved portion of said shoulder cushion, said panel being comprised of a deformable material, each of said first end and said second end of said head cushion being directed toward said intersection between said straightened portions and said curved portion, said curved portion of said shoulder cushion curving away from said head cushion, said panel being comprised of a deformable material thereby facilitating said head cushion to rest against said shoulder cushion for storage.

* * * * *